United States Patent [19]

Komaki et al.

[11] 4,038,545

[45] July 26, 1977

[54] ELECTROSTATIC RECORDING PROCESS AND IONIZING RADIATION IMAGE RECORDING METHOD EMPLOYING THE SAME

[75] Inventors: Takao Komaki; Kazuo Horikawa; Satoru Honjo; Seiji Matsumoto, all of Asaka, Japan

[73] Assignee: Fuji Photo Film Co., Ltd., Minami-ashigara, Japan

[21] Appl. No.: 693,641

[22] Filed: June 7, 1976

[30] Foreign Application Priority Data

June 6, 1975 Japan ..... 50-68369
June 9, 1975 Japan ..... 50-69387

[51] Int. Cl.[2] ..... G03G 13/00; G03G 15/00
[52] U.S. Cl. ..... 250/315 A; 250/315 R
[58] Field of Search ..... 250/315 R, 315 A

[56] References Cited

U.S. PATENT DOCUMENTS 2,825,814 3/1958 Walkup ..... 250/315 A

*Primary Examiner*—Alfred E. Smith
*Assistant Examiner*—B. C. Anderson
*Attorney, Agent, or Firm*—Gerald J. Ferguson, Jr.; Joseph J. Baker

[57] ABSTRACT

Disclosed is an electrostatic recording method for forming an electrostatic latent image on a dielectric electrostatic recording layer provided on a conductive support. The relationship between the thickness $d$[μm] and the specific dielectric constant $\epsilon_s$ of the electrostatic recording layer is such that the ratio of $d$[μm] to $\epsilon_s$, i.e. $d/\epsilon_s$[μm], is not larger than 1.65[μm] when the image recorded is of reflection type and not larger than 1.5[μm] when it is of transmission type. The latent image formed on the recording layer is developed by use of electrophotographic liquid developer. Also disclosed is an ionizing radiation image recording method wherein ionizing radiation carrying image information is directed onto a material which generates photoelectrons or a gas which is dissociated upon receipt of the ionizing radiation to an extent corresponding to the intensity of the radiation. In this method, the ratio of the thickness of the electrostatic recording layer to the specific dielectric constant is selected to be not larger than 1.5[μm] when the image is of reflection type and not larger than 1.0[μm] when it is of transmission type.

2 Claims, 10 Drawing Figures

ELECTROSTATIC RECORDING PROCESS AND IONIZING RADIATION IMAGE RECORDING METHOD EMPLOYING THE SAME

BACKGROUND OF THE INVENTION

1. Field of the Invention

This invention relates to an electrostatic image recording method wherein visible images are formed by developing electrostatic latent images on the surface of an insulator by an electrophotographic process.

More specifically, this invention relates to a method of recording images by use of ionizing radiation such as X-ray, $\alpha$-ray, $\beta$-ray, $\gamma$-ray, ultraviolet-ray or the like.

2. Description of the Prior Art

In the conventional electrographic printing process, electrostatic recording materials including a dielectric layer deposited on a conductive support for the purpose of imagerecording, or containing a recording layer made of an insulator placed on a conductive interlayer which is additionally positioned on a dielectric support have been employed. An electrostatic latent image can be produced on such a recording material by allowing charged particles to adhere to the recording layer thereof according to the imagewise distribution.

Electrostatic latent images can be formed by various conventional methods. For example, there has been known a method which comprises scanning the surface of a dielectric layer with a needle impressed with voltage wherein the needle and the dielectric layer are put into contact or near contact as disclosed in Japanese Patent Publication No. 16453/69. Further, there is known a method which employs electric current created by photoelectric effect caused on a light-exposed area of a material placed in face-to-face relationship with a recording material as disclosed in U.S. Pat. No. 3,508,477. Another method comprises the steps of applying a potential between a photoconductor provided in contact with a dielectric surface and a recording material, and at the same time subjecting the photoconductor to imagewise exposure as described in U.S. Pat. No. 3,326,709 and by Eichi Inoue in "Electrophotographic Techniques" (Denshi Shashin Gijutsu published by Kyoritsu Publishers), particularly on page 43. Also is known a method which comprises applying charges directly on a recording material by irradiating it with an electron beam as disclosed in U.S. Pat. Nos. 2,200,741 and 2,281,638. Further, there is known another method which comprises erasing in an imagewise pattern charges uniformly provided on the surface of a recording material in accordance with the pattern.

In addition to the widely prevailing method using silver halide photographic materials, various methods for recording ionizing radiation images are known, such as xeroradiography as disclosed in, for example, U.S. Pat. No. 2,666,144. Xeroradiography, based on the principle of xerography, comprises forming an electrostatic latent image by use of X-rays instead of visible light, the latent image consisting of charged and uncharged areas corresponding respectively to non-irradiated areas and areas irradiated with X-rays, and then developing the image with a toner. If necessary, the toner image thus obtained can be transferred to a plastic sheet or plate, or the electrostatic latent image can be transferred to a resin plate before being developed whereby development is carried out on the resin plate.

Further, still other ionographic methods are known, one of which is called "ionography" as set forth in U.S. Pat. No. 2,900,515 and Japanese Patent Public Disclosure No. 82791/73, and another of which is reported in "Zeitschrift fur Angewandte Physik", Vol. 19, p. 1 - 4 (Feb. 19, 1965). Both of these techniques are capable of providing increased sensitivity up to several ten times as high as that of xeroradiography. In the former process, gas molecules (mostly of large atomic number) sealed in a space are dissociated by the ionizing radiation. The dissociated charges are collected on an insulating film to produce an electrostatic latent image corresponding to the distribution of the radiation intensity, and then the latent image is converted to a visible image by applying a suitable developer material thereon. On the other hand, the latter process utilizes an arrangement comprising a cathode of heavy metal of large atomic number such as lead, and an anode of light metal of small atomic number such as aluminium placed parallel to each other across an intervening space filled with a gas. When ionizing radiation is directed thereon together with the application of an electric field, photoelectrons starting from the cathode advance through the gas layer towards the anode, and are accelerated by the electric field thereby to dissociate a number of gas molecules. The number of electrons is markedly increased and these electrons form an electrostatic latent image on an insulating layer provided on the anode. The electrostatic latent image thus prepared can be developed into a visible image, as in the former method, using any of the conventional electrophotographic development processes.

As examples of similar methods for forming an electrostatic latent image, there are further known a method of utilizing an electrical discharging phenomenon which takes place in gas molecules irradiated with X-rays as disclosed in U.S. Pat. No. 3,692,948, a method which takes advantage of the variation in ion current caused by a photoconductive mesh being irradiated with X-rays as disclosed in Japanese Patent Public Disclosure No. 98247/74, U.S. Pat. No. 3,603,790, Japanese Patent Public Disclosure No. 32534/73, etc., a method of multiplying ion current generated in gas molecules using micro-channel as disclosed in Japanese Patent Public Disclosure No. 17640/75, etc., a method of employing a liquid as a material capable of generating photoelectrons as disclosed in Japanese Patent Public Disclosure Nos. 137176/75, 87793/75 and 92733/75, and a method of erasing charges which have been uniformly provided on the surface of a recording layer by collecting the charges in an imagewise pattern by the above-described methods.

A feature common to these methods is that electrostatic latent images are produced by charged particles generated by ionizing radiations passing through a gas or a liquid layer and collected on the surface of an electrostatic recording layer.

On the other hand, it is known that the conventional developing method using a liquid developer is capable of converting the electrostatic latent image prepared by one of the abovedescribed electrostatic latent image forming methods or ionizing radiation image recording methods into a visible image of the highest quality known in prior art and of appreciably high image-density considering the low surface potential of the recording layer.

Nonetheless, a kind of image blur known as the "streak" phenomenon generally arises in the course of development, with a liquid developer, of the electrostatic latent image formed on the smooth surface of a recording layer such as is possessed by the common electrostatic recording materials. The streaks are caused by toner particles attaching to the areas of low density in the vicinity of an area of high density in a pattern resembling the tail of a comet. This phenomenon not only deforms the image, but also lowers the quality of the image by degrading the sharpness, resolving power and contrast. It further lowers the maximum density of the image.

In the ionizing radiation image recording methods wherein an electrostatic latent image is produced by charges passing through a gas layer or a liquid layer onto the surface of a recording layer of a recording material and adhering thereto in an imagewise distribution, there is another disadvantage in addition to the aforesaid streak phenomenon in that the electric charges first adhering to the surface of the recording layer raise the potential thus causing the repulsion of electric charges which arrive later in the course of charge collection. This repulsion phenomenon between the charges first adhering to the surface and the charges coming to adhere thereto later adversely affects the efficiency of collection of charges on the surface of the recording layer and not only causes a reduction in image density because of the smaller number of collected charges, but also degrades the sharpness, resolution and contrast of the image because the charges coming to adhere to the surface, mainly to the areas of high potential, are deflected in other directions in the gas layer so that the charges adhere to other areas where they should not adhere.

SUMMARY OF THE INVENTION

It has been found by the present inventors that there is a very close relationship between the streak phenomenon and the image density which is derived from the development of an electrostatic latent image formed on a recording material using a conventional electrophotographic development process, and also between the thickness and the specific dielectric constant of the recording layer of the recording material. Namely, they discovered that images of high quality, i.e., of both high image density and extremely reduced streaking, can be obtained by selecting a proper ratio of the thickness of the recording layer of the recording material to the value of the dielectric constant of said recording layer.

In addition, they also found that there is a very close relationship between the efficiency of charge collection when an electrostatic latent image is formed by charges provided on a recording material according to an imagewise distribution or the streak caused by the development of said electrostatic latent image using a conventional electrophotographic liquid developer, and the the thickness and the dielectric constant of the recording layer of the recording material. Namely, it becomes possible to enhance the efficiency of charge collection and remarkably reduce streaking by determining the optimum ratio of the thickness of the recording layer to its inherent dielectric constant. By employing a recording layer posessed of such an optimum ratio it is possible to form images bearing high density, excellent sharpness, high resolution and high contrast.

Therefore, an object of the present invention is to provide an electrostatic recording method which not only reduces streaking, thereby improving the sharpness, resolution and contrast of the images, but also provides images of high density.

Another object of the present invention is to provide an electrostatic recording method which not only can reduce the occurrence of streaking, but also can enhance the efficiency of charge collection when electric charges are given to a recording material, thereby improving the density, sharpness, resolution and contrast of the recorded images.

A further object of the present invention is to provide an ionizing radiation image forming method which is capable of obtaining ionizing radiation images having the desirable characteristics mentioned above.

It has been found that the above-described objects can be accomplished by an electrostatic recording method characterized in that an electrostatic latent image is produced on the surface of a dielectric electrostatic recording layer provided on a support at least the surface of which has conductivity by using a dielectric layer whose thickness $d$ [$\mu$m] and specific dielectric constant $\epsilon_s$ stand in such relationship that the ratio of $d$ [$\mu$m] to $\epsilon_s$, i.e., $d/\epsilon_s$ [$\mu$m], is not larger than 1.65 [$\mu$m] when reflection type images are formed on said layer, and not larger than 1.5 [$\mu$m] when transmission type images are formed thereon, and then by developing the latent image thus prepared with an electrophotographic liquid developer.

The objects described above are also accomplished by an ionizing radiation image recording method characterized in that charged particles are produced by a material capable of generating photoelectrons or gas, liquid or the like molecules capable of being dissociated in proportion to the intensity of ionizing radiation rays carrying image information. The resulting charged particles are collected on the surface of a dielectric electrostatic recording layer provided on a support at least the surface of which has conductivity by applying external electric field thereto to result in the formation of an electrostatic latent image corresponding to the image information. The electrostatic recording layer is a dielectric layer whose thickness $d$ [$\mu$m] and specific dielectric constant $\epsilon_s$ are so related that the ratio of $d$ [$\mu m$ ] *to* $\epsilon_s$, i.e. $d/\epsilon_s$ [$\mu$m ], is not larger than 1.5 [$\mu$m] when the image recorded on said layer is of reflection type, and not larger than 1.0 [$\mu$m] when the image is of transmission type. The latent image thus prepared is developed with an electrophotographic liquid developer.

The ratio of the thickness of the dielectric layer $d$ [$\mu$m] to the specific dielectric constant thereof $\epsilon_s$, i.e. $d/\epsilon_s$ [$\mu$m], will be referred to simply as $d/\epsilon_s$ hereinafter. Therefore, $d/\epsilon_s = 1.0$ hereinafter means $d/\epsilon_s = 1.0$ [$\mu$m].

DESCRIPTION OF THE PREFERRED EMBODIMENTS

Now the present invention will be described in detail with reference to the accompanying drawings.

Figure 1A:
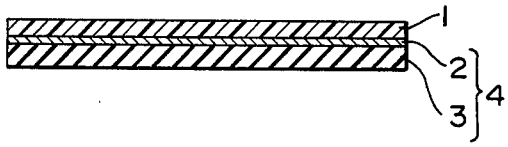
FIGS. 1A and 1B are diagrammatic cross-sections of different embodiments of a recording material employed in this invention.
Figure 1B:
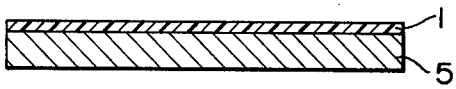

FIGS. 1A and 1B show examples of a recording material used in this invention. FIG. 1A illustrates a recording material comprising a recording layer 1 and a support 4 composed of a conductive interlayer 2 and a dielectric layer 3. FIG. 1B illustrates a recording material comprising a conductive support 5 and a recording layer 1 provided thereon.

Figure 2:
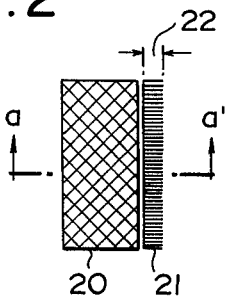
FIG. 2 is a diagram showing an image and an image streak formed by a conventional developing process.

FIG. 2 schematically illustrates an image obtained by developing an electrostatic latent image formed on a recording material as shown in FIG. 1 by use of a liquid developer, wherein a developed image of rectangular shape is indicated by the reference numeral 20. The reference numeral 21 represents an image streak appearing in the non-image area in the vicinity of the image 20. The streak 21 results from a stream of the developing solution caused by the stirring thereof in the course of the developing process, and appears in the general downstream direction of the stream. Although a streak 21 of this kind is, of course, undesirable from the viewpoint the quality of the image, it is impossible to obtain an image completely free from streaks. Therefore, the length 22 of the streak is desired to be made as short as possible.

Figure 3:
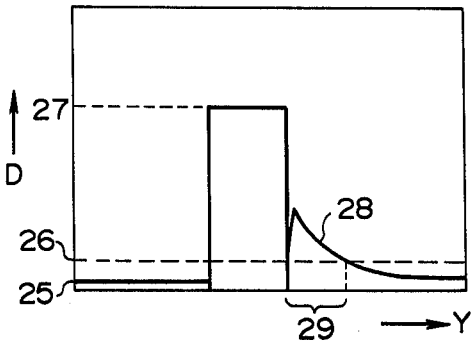
FIG. 3 is a graph illustrating the distribution of image density.

FIG. 3 shows the image density along the *a—a'* in FIG. 2. In FIG. 3, the abscissa represents the position of the image along the line *a—a'* and the ordinate represents the optical density. The optical density of the area having no image but only fog is indicated by 25, an optical density higher than that of the no-image area 25 by 0.2 is indicated by 26, and the optical density of the image area is indicated by 27. The curve 28 represents the density distribution of the image streak 21. Ordinarily, the streak density is high in the vicinity of the image area and decreases with increasing distance from the image area as shown in FIG. 3. In the present specification, the magnitude of the streak is defined by the visible length 29 which corresponds to the distance between the end of the image area and the point at which the optical density becomes equal to the value 26 which is larger by 0.2 in optical density than the sum of the density 25 of the recording material per se and the fog. Thus, it can be said that the streak is small when the length 29 is small.

Figure 4:
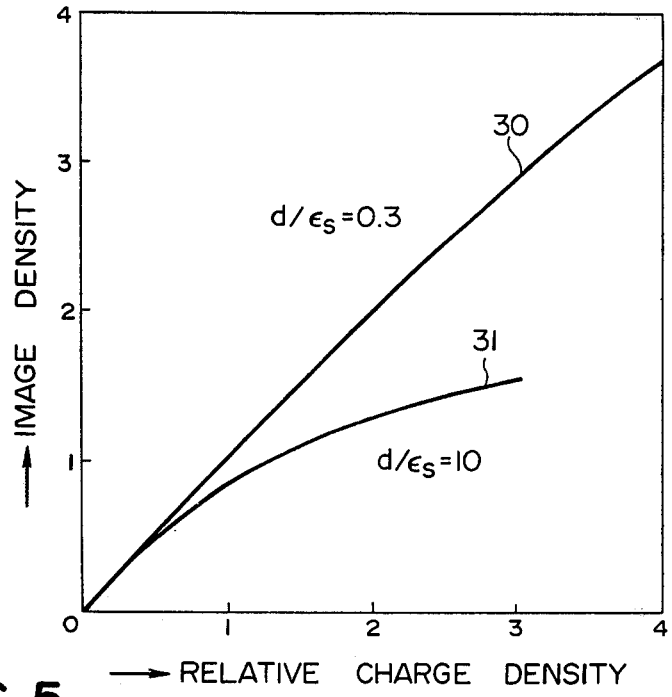
FIG. 4 is a graphical representation showing the relationship between the image density obtained and the electric charge density provided on a recording layer.

FIG. 4 shows the relationship between the image density obtained by development of charges formed on a recording layer and the charge density. This result was obtained by an electrophotographic liquid developing technique using a development electrode. The abscissa is graduated in units each representing a relative charge density of 10−6 to 10−8 coulomb/cm$^2$. On the other hand, the ordinate indicates the transmission diffusion image density. The curve 31 indicates an example in which the ratio of the thickness of the recording layer $d$ to the specific dielectric constant thereof $\epsilon_s$, i.e. $d/\epsilon_s$, equals 10. The curve 30 indicates an example in which $d/\epsilon_s = 0.3$. In the former case, the value of transmission diffusion image density is linearly proportional to the charge density only in the region less than 1 on the abscissa, and there is a tendency for the value of transmission diffusion image density to saturate in the region larger than 1 on the abscissa. On the other hand, in the latter case the image density is linearly proportional to the charged density over a wide range. The quality of the image obtained in the latter case is much better than that obtained in the former case.

Figure 5:
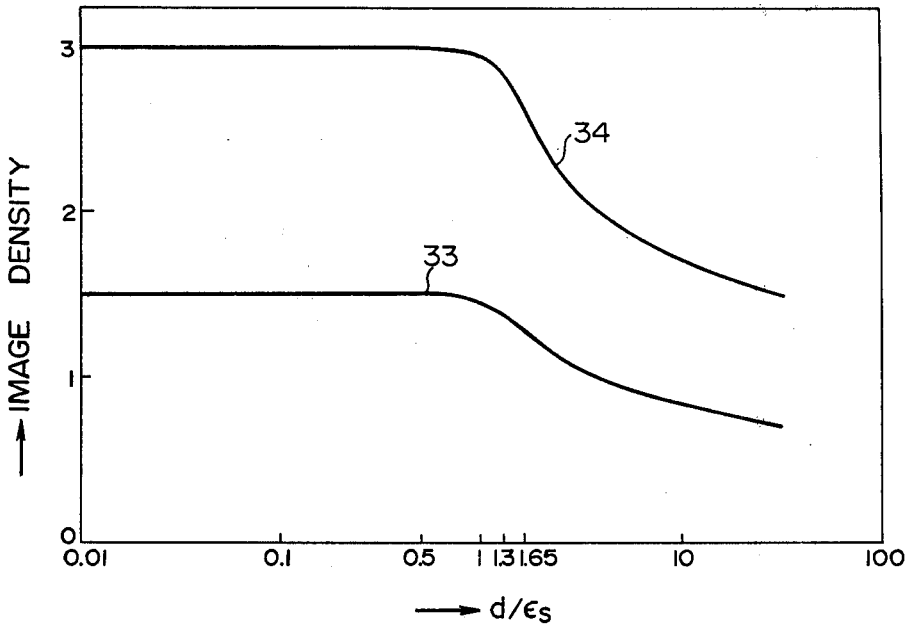
FIG. 5 is a graphical representation showing the relationship between the image density and $d/\epsilon_s$ in logarithmic scale.

The relationship between $d/\epsilon_s$ and the image density will now be described in detail. FIG. 5 illustrates the manner in which the image density (transmission density) obtained by developing a charge image of a predetermined charge density provided on a recording layer changes as the value of $d/\epsilon_s$ increases. The aforesaid predetermined charge amount is determined so as to satisfy the conditions that the image produced by the electrostatic recording method should have an image density high enough to be observable using reflection light (the image thus observed is hereinafter called a reflection type image), that is, a density corresponding to a value within the range of 1.0 1.5 in terms of the transmission density, or high enough to be observable using transmission light (the image thus observed is hereinafter called a transmission type image), that is, a density corresponding to the value 3.0 in terms of the transmission density. The curve 33 in FIG. 5 represents the relationship between the image density obtained when the charge density in terms of the relative charge density is 1.5 on the basis of the data in FIG. 4 which corresponds to the charge density required to gain the transmission density value of 1.5, which is necessary to observe the image to be obtained as a reflection type image, in case of using the recording layer having a $d/\epsilon_s$ of 0.3 in FIG. 4, and the corresponding $d/\epsilon_s$ value. Similarly, the curve 34 illustrates the relationship between the image density obtained when the electric charge density required for obtaining a transmission density value of 3.0 as a transmission type image is provided on the recording layer, and the corresponding $d/\epsilon_s$ value. On the basis of the results shown in FIG. 4, the relative electric charge density of this kind was determined as 3.1.

It is seen from the results shown in FIG. 5 that:

1. image density is constant in the range of $d/\epsilon_s < 0.5$,
2. image density slightly decreases as the value of $d/\epsilon_s$ increases in the range of $0.5 < d/\epsilon_s < 1.0$,
3. image density further decreases gradually as the value of $d/\epsilon_s$ increases in the range of $1.0 < d/\epsilon_s < 1.3$, and
4. image density decreases abruptly as the value of $d/\epsilon_s$ increases in the range of $d/\epsilon_s > 1.3$.

It is assumed from the results of this experiment that in case of large $d/\epsilon_s$ values, toner particles once adhered to the image area move therefrom to non-image areas and adhere to the plate at places to which they have moved. This movement of toner particles is considered to cause the streak phenomenon. Therefore, the streak phenomenon, which degrades both sharpness and resolution and affects the image quality more adversely than does the lowering of image density, was examined on the basis of the definition gives above in connection with FIG. 3.

Figure 6A:
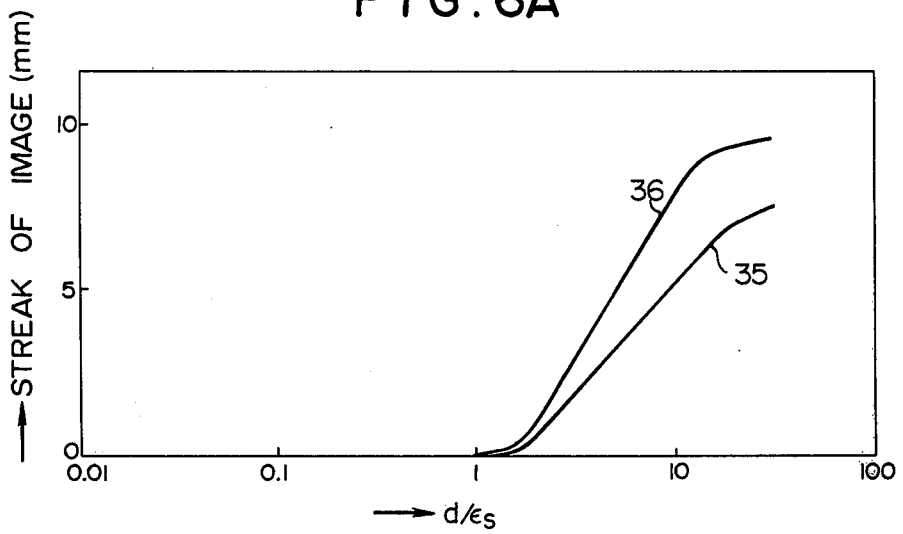
FIGS. 6A and 6B are graphs illustrating the manner in which the streaking changes as $d/\epsilon_s$ changes.
Figure 6B:
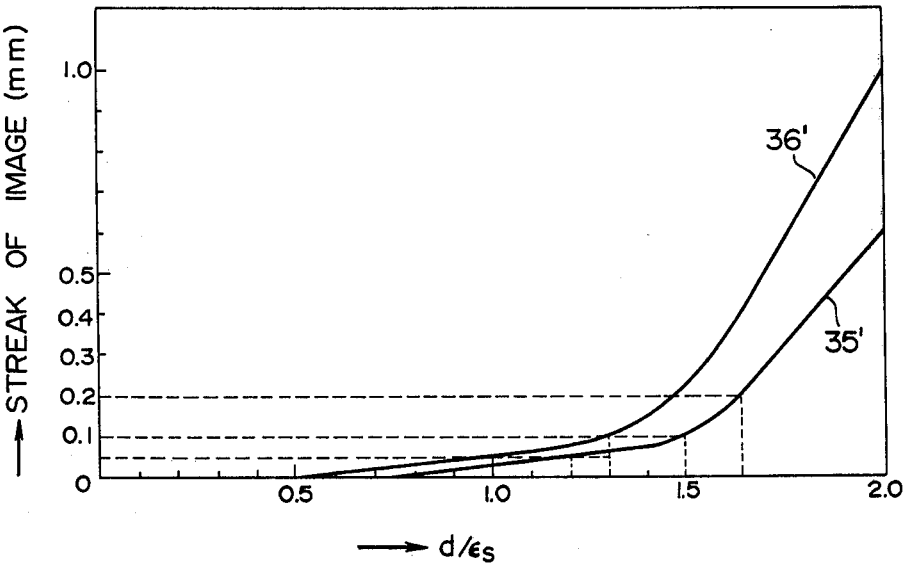

FIGS. 6A and 6B show the relationship between the magnitude of image streak produced in the process of developing a recording layer on which the same amount of charge density as in FIG. 5 is provided, and the corresponding $d/\epsilon_s$ value. The numerals on the abscissa are in logarithmic scale and indicate the values of $d/\epsilon_s$ in FIG. 6A. Further, the streak phenomenon is illustrated in detail in FIG. 6B which is an enlargement of the significant part of the curves in FIG. 6A. In FIG. 6B, the numerals on the abscissa are in antilogarithmic scale instead of logarithmic one scale. In both FIGS. 6A and 6B, the numerals on the ordinate indicate the magnitude of image streak (mm). The curve 35 and the curve 35' show how the magnitude of image streak varied as the value of $d/\epsilon_s$ varied when the charge density required to obtain an image having a transmission density value of 1.5 was provided on the recording layer, that is to say, when a reflection type image was formed, similarly to the case of curve 33 in FIG. 5. On the other hand, the curve 36 and the curve 36' show how the magnitude of image streak varies as the value of $d/\epsilon_s$ varies when the charge density required to obtain the image having the transmission density value of 3.0 is provided on the recording layer, that is to say, when a transmission type image is formed, similarly to the case of curve 34 in FIG. 5.

It was found in case of producing a reflection type image (from the curve 35 and the curve 35') that:

1. no visible image streak occurs in the range of $d/\epsilon_s < 0.75$,
2. the magnitude of the image streak increases gradually with the increase of the value of $d/\epsilon_s$ in the range of $0.75 < d/\epsilon_s < 1.5$, and
3. in the range of $d/\epsilon_s < 1.5$ the magnitude of the image streak increases fairly rapidly at first, and then shows a precipitous increase with the increase in the value of $d/\epsilon_s$.

In addition, it was found in case of producing a transmission type image (from the curve 36 and the curve 36') that:

1. no visible image streak occurs in the range of $d/\epsilon_s < 0.5$,
2. the magnitude of the image streak increases gradually with the increase of the value of $d/\epsilon_s$ in the range of $0.5 < d/\epsilon_s < 1.3$, and
3. in the range of $d/\epsilon_s > 1.3$ the rate of increase in the magnitude of image streak gradually increases at first with the increase of the value of $d/\epsilon_s$, but as the value of $d/\epsilon_s$ further increases it shows a steep rise.

A detailed consideration of these facts verifies the aforesaid assumption that toner particles once adhered to the image area are dislodged in the course of development to give rise to image streak because the value of $d/\epsilon_s$ corresponding to the decrease in the image density confirmed in FIG. 5 is in fair agreement with the value of $d/\epsilon_s$ corresponding to the increase in the magnitude of image streak in FIG. 6.

On the basis of the above-described results, it is understood that the values of $d/\epsilon_s$ corresponding to the region wherein the image streak is inconspicuous (specifically, when the magnitude of image streak is less than 0.2mm) are smaller than 1.65 in case of the reflection type image, and smaller than 1.5 in case of the transmission type image. In addition, the values of $d/\epsilon_s$ within the above-described region give good results in terms of the image density obtained for the same quantity of charge provided on the recording layer. Further, in this region the degree of increase in the magnitude of image streak is comparatively small. Therefore, if the ratio of the thickness of the recording layer to the value of the dielectric constant thereof, i.e. $d/\epsilon_s$, is predetermined to be less than 1.65 in case of the reflection type image, and less than 1.5 in case of the transmission type image, the image produced by developing an electrostatic latent image formed on the electrostatic recording layer of an electrostatic recording material by use of a liquid developer is of high quality. In the above-described $d/\epsilon_s$ value range, the image density is high, and the magnitude of image streak can be reduced to a very small value so as to cause only a small drop in sharpness and resolution.

More desirable $d/\epsilon_s$ values of the recording layer will be described below.

A resolution of about 5 lines/mm is usually required for an image produced by an electrostatic recording method. On the other hand, image streak of a magnitude of less than 0.1mm has no effect on an image having a resolution on the aforesaid order. Therefore, the value of $d/\epsilon_s$ corresponding to a magnitude of image streak within the aforesaid range is within the range of less than 1.5 in the curve 35', and within the range of less than 1.3 in the curve 36'. Namely, when the value of $d/\epsilon_s$ is present within the range of less than 1.5 with respect to a reflection type image, and less than 1.3 with respect to a transmission type image, an image having a resolution of 5 lines/mm can be formed without suffering from the streak phenomenon.

In a similar manner, images having higher resolution and having no image streak can be formed by fixing the $d/\epsilon_s$ value within the range of less than 1.2 with respect to a reflection type image, and less than 1.0 with respect to a transmission type image. Further, it becomes possible to visualize the electrostatic latent image with faithful reproducibility with no occurrence of the streak phenomenon by specifying the $d/\epsilon_s$ value within the range of less than 0.75 in case of a reflection type image, and less than 0.5 in case of a transmission type image. In addition, it is apparent from the results shown in FIG. 5 that an image of high density can be obtained by adopting $d/\epsilon_s$ values within the above-described preferable range.

The relationship between the $d/\epsilon_s$ value of a recording layer and the streak phenomenon caused by the development of an electrostatic latent image formed on a recording layer of an electrostatic recording layer using an electrophotographic liquid developer has been described above. The present invention also provides an effective method of producing an electrostatic latent image by giving electric charges to a recording layer.

Therefore, it can be said that electrostatic recording materials whose recording layers have a preferred ratio of thickness d to the specific dielectric constant thereof $\epsilon_s$, i.e. $d/\epsilon_s$, contribute to an increase in sensitivity and resolution, as well as to the formation high-contrast and streak-free images.

There is a method called "ionography" as disclosed in, for example, U.S. Pat. No. 2,900,515 and Japanese Patent Public Disclosure No. 82791/73. Ionography comprises forming an electrostatic latent image by dissociating gas molecules sealed in a predetermined space (e.g., air, gas containing as a main component rare gas such as argon, krypton, xenon, etc., monobromomethane ($CH_3Br$) or the like) with ionizing radiation, and then by collecting the dissociated charges on an insulating recording layer with the application of an external electric field. In this method, the charges adhered to the recording layer in the process of collection give rise to surface potential on the recording layer. The resulting surface potential acts to weaken the electric field applied with the intention of collecting the dissociated charges, and hinders the collection of a large number of charges. In addition, charges which later approach the area wherein an electrostatic latent image consisting of fine lines is present are repelled by previously attached charges, and adhere to other adjacent low charged areas, resulting in a lowering of the sharpness and resolution of the images obtained. Therefore, even if the same quantity of charges are collected, the resulting surface potential is desired to be as low as possible.

Figure 7:
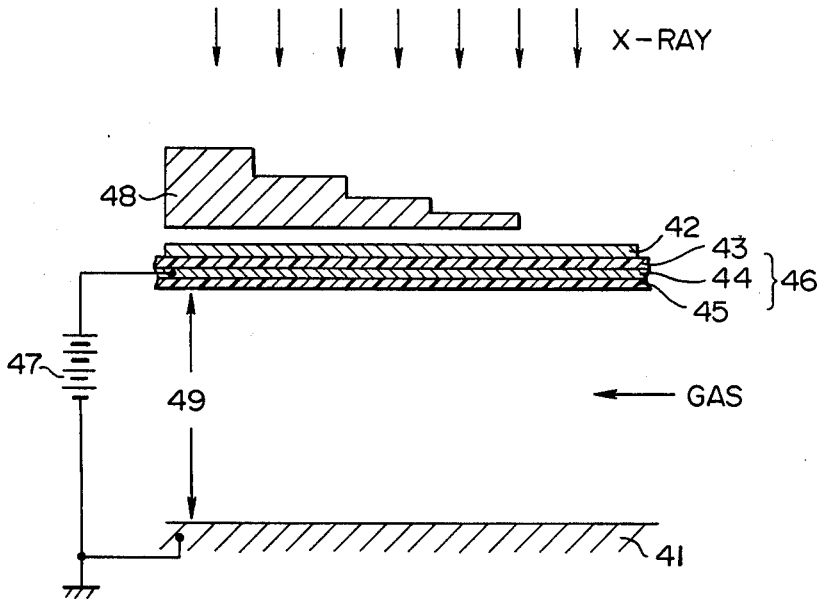
FIG. 7 is a diagrammatic cross-sectional view of one embodiment of the apparatus employed for carrying out the method in accordance with this invention.

Furthermore, there is known another ionizing radiation recording method which was reported in "Zeitschrift fur Angewandte Physik", by Reiss Vol. 19, p.1-4 (Feb. 19, 1965). An outline of this method is illustrated in FIG. 7.

The reference numeral 41 represents a cathode made of a metal having a large atomic number such as lead, gold, silver, tungsten, platinum, etc., or oxides of these metals, or a layer of one of these metals provided on a supporting plate. When irradiated with X-rays or the like, cathode 41 is capable of emitting photoelectrons in proportion to the amount of radiation absorbed. An anode 42 made of a metal having a small atomic number (for example, a plate of alminium, alminium magnesium alloy, beryllium, etc.), or a plastic plate (e.g., acrylic resin or epoxy resin containing carbon fibers) provided with a thin metallic film by deposition is placed parallel to the cathode 41. A recording member 46 is placed on the anode 42 to face the cathode. The recording member 46 consists of a transparent or opaque support 43, a conductive layer 44, and a recording layer 45. An electric potential is applied between the cathode 41 and the conductive layer 44 by means of an electric source 47. The conductive layer 44 may be made of a metallic plate which serves also as a support, or may be a thin metallic film provided on a plastic film by deposition or a conductive layer provided on a plastic film by application of a conductive paint thereon. The photoelectron-emitting surface of the cathode 41 and the recording member 46 are separated from each other by a distance on the order of 0.1 - 10mm. The space 49 is filled with a gas capable of generating secondary electrons or capable of generating dissociated charges upon irradiation with X-ray. Specific examples of gases with which the space is filled are mixed gases containing as a main component a gas having an atom with an atomic number of more than 17, and more preferably more than 35, such as argon, xenon, krypton, $CH_3Br$, $CH_3I$, $CF_3Br$, $CCl_4$, $CH_2Cl_2$ or the like, and as a quenching gas methane, isobutane, carbon dioxide or the like. An airtight apparatus used for sealing such gas molecules in the space 49 is omitted in FIG. 7. The numeral 48 represents a subject.

The functioning of this equipment will now be described. Ionizing radiation, particularly X-ray emitted from an X-ray tube in this example, is absorbed by the subject. There arises a distribution in intensities among the X-rays transmitted by the subject in proportion to the extent of absorption thereby. The transmitted X-rays reach the photoelectron emissive layer of the cathode 41 and cause the emission of electrons at rates corresponding to the intensities thereof. The electrons emitted by the aforesaid external photoelectric effect are accelerated by the electric field applied between the anode 42 and the cathode 41, and collide with the gas molecules sealed in the space 49 to cause the generation of secondary electrons. Each electron emitted by the photoelectric effect produces a number of secondary electrons before it arrives at the anode. Thus, the number of electrons is multiplied by a large factor. These electrons reach the recording layer 45 provided on the anode, and they are collected as charges on the recording layer 45 to give rise to an electrostatic latent image which will be developed in the subsequent process.

In this process, however, the electron multiplication factor varies exponentially with the electric potential formed between the cathode 41 and the anode 42. Accordingly, the effective strength of the electric field applied to the space 49 is reduced when the charges collected on the recording layer 45 have high surface potential, and the multiplication factor is also lowered remarkably. As a result, a drop in the efficiency of charge collection is produced. Consequently, a remarkable reduction in sensitivity results. In addition, later-arriving charged particles are repelled by the high surface potential present on the recording layer, and escape in the transverse direction. Thus, the sharpness, the resolution and the contrast of the image obtained are remarkably lowered.

Further, a method using a liquid as the photoelectron-generating substance has been reported, for example, in Japanese Patent Public Disclosure Nos. 137176/75, 87793/75 and 92733/75. In this method, the space 49 in FIG. 7 is filled with a liquid capable of absorbing X-rays instead of the gas molecules in the aforesaid method. This X-ray absorbing liquid must be electrically non-conductive. Liquids with electric resistance of more than $10^{13}$ Ωcm are preferred. In addition, the above-described liquid must absorb the incident X-rays to produce both electrons and cations. Atoms having an atomic number of not less than 17, and more preferably not less than 35 are additionally incorporated into the liquid. For example, a rare gas such as xenon, krypton, or the like, or a compound containing atoms of high atomic numbers is dissolved into a solvent such as hexane, Isopar-G (An isoparafin series solvent manufactured by Esso Standard Oil Co.), p-xylene, toluene, mesithylene, n-heptane or kerosene.

This method also has the same disadvantages as the above-described method using gas molecules.

In addition, the undesirable phenomenon as described above also appears in the course of the formation of an electrostatic latent image in accordance with an electrographic printing process in the same way as in the above-described electroradiographic methods.

An undesirable feature common to these recording methods is that the efficiency of charge collection is lowered by the increased electric potential resulting from charges collected on the insulating recording layer in the course of charge collection, because later charges to be collected thereon are repelled by the increased electric potential. Consequently, sharpness and resolution are also lowered by the increased electric potential. Therefore, this disadvantage can be overcome by minimizing the surface potential produced on the recording layer without reducing the amount of charges attached thereto.

On the other hand, the surface potential produced on the recording layer can be minimized by using a recording layer having a small $d/\epsilon_s$ value without reducing the amount of charges attached to the recording layer in accordance with one embodiment of the present invention. Namely, in experiments by the inventors, the surface potential produced on the recording layer when charges were provided thereon in the amount of $2 \times 10^4$ coulomb/m$^2$ was 226V in case of $d/\epsilon_s = 10$, 22V in case of $d/\epsilon_s = 1$, and 6.6V in case of $d/\epsilon_s = 0.3$.

Accordingly, when the value of $d/\epsilon_s$ is selected to be small, it becomes possible not only to reduce the image streak arising in the developing treatment, but also to greatly minimize the affect on charge collection in the case of forming an electrostatic latent image on a recording layer. In other words, it is possible to avoid the drop in the efficiency of charge collection and the reduction in the sharpness and resolution of the image obtained. Therefore, images of very good quality can be obtained.

Figure 8:
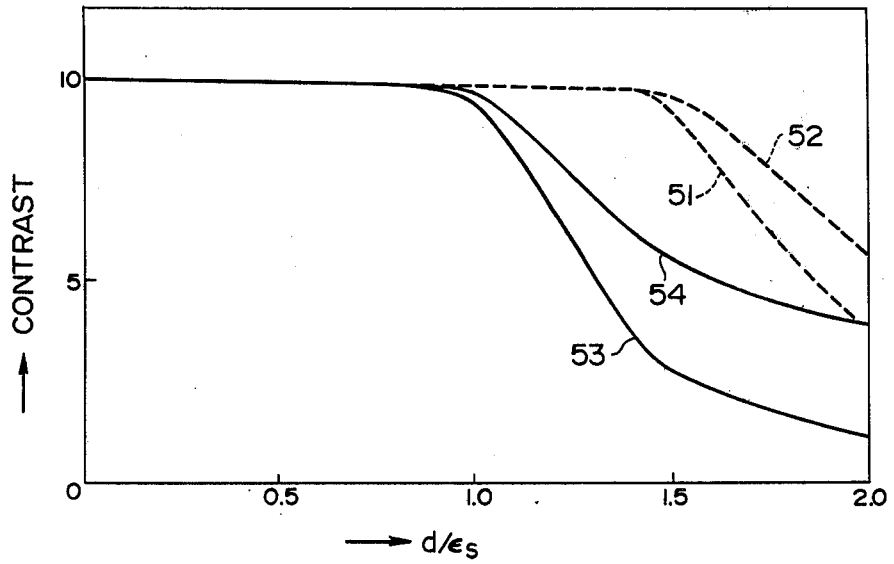
FIG. 8 is a graphical representation showing the relationship between the contrast of image and the ratio $d/\epsilon_s$ of the recording layer.

Now, an explanation is made with reference to FIG. 8. In FIG. 8, the numerals on the abscissa correspond to the ratio of the thickness of a recording layer d to the value of the specific dielectric constant thereof $\epsilon_s$, i.e. $d/\epsilon_s$, and the numerals on the ordinate correspond to the relative contrast of the image produced by developing an electrostatic latent image with a resolution of 4 lines/mm formed on the recording layer having the predetermined $d/\epsilon_s$ value by providing charges according to an imagewise distribution thereon.

Different charge amounts were selected for recording a reflection type image and a transmission type image. The charge amount in the case of a reflection type image was set to be equal to half the charge amount in the case of a transmission type image. The curve 51 and the curve 52 show the contrast values of images obtained as a reflection type image on the recording layers having the respective $d/\epsilon_s$ values. The curve 51 corresponds to the case wherein, on the occasion of forming an electrostatic latent image, photoelectrons emitted from cathode were multiplied by a large factor using an external electric field and dissociated gas molecules and were then provided as charges on a recording layer, as reported in the article by Reiss, while the curve 52 corresponds to the case wherein no multiplication technique was adopted. In addition, the curve 53 and the curve 54 show the contrast values of transmission type images on recording layers having the respective $d/\epsilon_s$ values. The curve 53 corresponds to the case wherein multiplied charges are provided on a recording layer on the occasion of forming an electrostatic latent image, while the curve 54 corresponds to the case wherein charges were provided on a recording layer without multiplication.

It was found in the case of a reflection type image (curve 51 and curve 52) that:

1. the contrast is constant in the range of $d/\epsilon_s < 1.0$,
2. the contrast decreases gradually with the increase of the $d/\epsilon_s$ value in the range of $1.0 < d/\epsilon_s < 1.5$, and
3. the contrast decreases drastically with the increase of the $d/\epsilon_s$ value in the range of $d/\epsilon_s > 1.5$.

On the other hand, it was found from the results in the case of a transmission type image (curve 53 and curve 54) that:

1. the contrast is constant in the range of $d/\epsilon_s$ 0.5,
2. the contrast decreases gradually with the increase of the $d/\epsilon_s$ value in the range of $\mathbf{0.5} < d/\epsilon_s < 1.0$, and
3. the contrast decreases drastically with the increase of the $d/\epsilon_s$ value in the range of $d/\epsilon_s > 1.0$.

When the $d/\epsilon_s$ values of the recording layers for obtaining a reflection type image and a transmission type image are larger than 1.5 amd 1.0, respectively, the contrasts attained are lowered because both the potential from charges first adhering to the surface of the recording layer in the course of charge collection and the streak arising from the development of the electrostatic latent image obtained with an electrophotographic liquid developer adversely affect the contrast.

On the other hand, if the $d/\epsilon_s$ values of the recording layers for obtaining a reflection type image and a transmission type image are fixed to be smaller than 1.5 and 1.0, respectively, in accordance with a preferred embodiment of the present invention, it is possible to almost completely eliminate the loss of efficiency of charge collection and the degradation of sharpness and resolution which are caused by the potential of the charges which first adhere to the recording layer in the course of charge collection. Further, other disadvantages arising from the streak phenomenon which arises in the course of development of the resulting electrostatic latent image with an electrophotographic liquid developer, such as drops in image density, sharpness and resolution, can also be diminished. Therefore, the resulting images are remarkably improved of their quality.

The minimum $d/\epsilon_s$ value practically attainable depends upon both the lower limit of thickness of the recording layer and the power of the recording layer to retain charges. The minimum $d/\epsilon_s$ value attainable was determined to be about 0.01 in our experiments.

Recording materials which may be employed in the present invention will now be described hereinbelow with reference to FIG. 1. The support 4 or 5 can be metal plate of such as aluminium, copper, silver, gold or the like, glass or plastic films coated with a thin metallic film made of, for example, aluminium, palladium, copper, silver, gold or the like, or with a thin layer consisting of tin oxide, or paper treated to be conductive. Agents which may be employed for providing conductivity to paper those which are commonly used in the art of electrophotography: for example, polyvinyl benzyl trimethylammonium chloride, poly (N,N-dimethyl-3, 5-methylene piperidium chloride), polyvinyl benzene sodium sulfonate, colloidal alumina and so on are particularly useful.

Examples of electric insulating materials which may be used to constitute the recording layer 1 include a wide variety of natural and synthetic resins. As typical examples of such insulating materials, mention may be made of resin derivatives such as rosin and esters thereof, hydrogenated rosin and esters thereof, etc., dammar, aliphatic petroleum series hydrocarbon resins, polystryene, styrenated alkyd resin, styrene-olefin copolymer, silicon resin, alkyd resin, epoxy resin, polyalkylmethacrylate, styrene-alkylmethacrylate copolymer, polyvinyl chloride, polyvinyl fluoride, polyvinyl acetate, vinyl chloride-vinyl acetate copolymer, polyvinyl alcohol, polyethylene terephthalate, ethylcellulose, cellulose acetate, polyamide, polypropylene and so on. In addition, various kinds of plasticizers can be used in combination with each of these resins in order to make these resins function more effectively.

The recording member employed in the present invention can be produced by the methods well known in this art. A representative method comprises applying to a conductive layer a solution prepared by dissolving an electric insulating material to be employed us the recording layer into an appropriate solvent.

On the other hand, liquid developers employed in the present invention can be ordinary developers well known in this art. As examples thereof, mention may be made of the developer containing as a pigment carbon black as disclosed in Japanese Patent Publication No. 8511/70, and the developer as disclosed in Japanese Patent Publication No. 8510/70.

Recording materials of the kind which have one recording layer provided on only one side of a support have been described. However, recording materials of a kind which have two recording layers, one provided on either side of a support via an associated conductive layer can also be produced, and images can be formed on both sides of these recording materials according to ionography or methods similar thereto. In such case, an electrostatic latent image can be produced in a conventional manner on the recording layer which stands face to face with an X-ray source, and on the other recording layer an electrostatic latent image can be produced using X-rays transmitted through the recording material.

EXAMPLE 1

A resinous solution was prepared by diluting with butyl acetate a solution prepared by dissolving a resinous component consisting of 70 wt % of polyvinyl chloride and 30 wt % of polyvinyl acetate into toluene in the concentration of 45 wt % (Denkalac No. 61 manufactured by TDK Co., Ltd.). A recording material employed for obtaining a transmission type image was produced by applying this solution as a recording layer on a transparent conductive layer prepared by depositing a thin palladium film onto the surface of a 100μ thick polyethylene terephthalate film. (The material consisting of a thin palladium film deposited on a polyethylene terephthalate film as described above is commercially available as Toray High Beam T-Type 100L-TL02) Recording layers having various dry thickness within the range of 0.09 to 90μ were prepared. The resulting recording layers each had a specific dielectric constant of about 3.

The resulting recording material was placed on a metal plate with the recording layer situated atop other components, and the conductive layer was earthed. A metal plate having a 2cm × 2cm aperture was placed on the surface of the recording layer and was subjected to corona charging. The corona charging apparatus used here was composed of a corona wire made of stainless steel having a diameter of 0.1mm and a shield case, and -7KV of DC potential was applied to the corona wire. The interval between the corona wire and the recording material was 30mm. The recording material was scanned with the corona charging apparatus at the scanning rate of 5cm/sec. Then, the recording material was developed with a liquid developer having the composition set forth below for one minute in a developing bath as the developing solution was allowed to move slowly along the surface of the recording material. The recording material was then gently rinsed with kerosene. A 2cm × 2cm rectangular image was obtained.

| Composition of the Developer | |
|---|---|
| Carbon Black (Pigment) | 5 wt % |
| Alkyd Resin (Binder) | 20 wt % |
| Isopar H (Diluent) | 80 wt % |

(Trade name for an isoparaffinic hydrocarbon solvent manufactured by Esso Standard Oil)
(On use, the carbon black and alkyd resin were mixed together with a small amount of Isopar H in a ball mill, and the resulting mixture was further diluted with Isopar H to the concentration of 100 wt %.)

Consequently, the results as shown by curve 34 in FIG. 5 were obtained. The transmission density was approximately 3.0 in the range of $d/\epsilon_s<0.5$, more than 2.9 in the range of $0.5<d/\epsilon_s<1.0$ and more than 2.8 in the range of $1.0<d/\epsilon_s<1.3$. On the other hand, in the range of $d/\epsilon_s<1.3$ the image density was found to decrease with the increase of the $d/\epsilon_s$ value.

Since the image density is easily improved by increasing the amount of charged particles whereas image streak seriously influences the quality of the image, the examination was concentrated on measuring the streak density using a microdensitometer. The magnitude of the streak was determined on the basis of the length over which the density of the streak exceeded base density + 0.2.

Consequently, the curve 36 and the curve 36' shown in FIGS. 6A and 6B, respectively, were obtained. The streak was completely missing in the range of $d/\epsilon_s<0.5$, the length of the streak was less than 0.05mm in the range of $0.5<d/\epsilon_s<1.0$, less than about 0.1mm in the range of $1.0<d/\epsilon_s<1.3$ and less than about 0.2mm in the range of $1.3<d/\epsilon_s<1.5$. On the other hand, in the range of $d/\epsilon_s>1.5$ the streak was found to increase drastically with the increase of the valve of $d/\epsilon_s$.

EXAMPLE 2

A recording layer was produced by applying a resinous solution prepared by the same process as that of Example 1 to a conductive layer formed beforehand on art paper of a thickness of 100μ by applying colliodal alumina to the surface thereof. Thus, a recording material for obtaining a reflection type image was obtained. A number of samples having recording layers of various dry thickness within the range of 0.09 to 90μ were prepared similarly to Example 1. Each of these samples was subjected to the same treatment and operation as in Example 1 except that the sample was scanned with the corona charging apparatus at the scanning rate of 10cm/sec instead of 5cm/sec.

Consequently, the curve 33 shown in FIG. 5 was obtained. The transmission density was approximately 1.5 in the range of $d/\epsilon_s<0.5$, and was more than 1.4 in the range of $0.5<d/\epsilon_s<1.2$. While, in the range of $d/\epsilon_s<1.2$ the image density additionally decreased with increase of the value of $d/\epsilon_s$.

The results shown by the curve 35 and the curve 35' of FIGS. 6A and 6B were obtained on examination with respect to the image streak as in Example 1. The streak was completely missing in the range of $d/\epsilon_s<0.75$, the length of the streaks was less than about 0.05mm in the range of $0.75<d/\epsilon_s<1.2$, less than about 0.1mm in the range of $1.2<d/\epsilon_s<1.5$ and less than about 0.2mm in the range of $1.5<d/\epsilon_s<1.65$. On the other hand, in the range of $d/\epsilon_s<1.65$ the streak was found to increase drastically with the increase of the value of $d/\epsilon_s$.

EXAMPLE 3

In addition to the equipment used in Example 1, a photoconductive mesh sieve of 200 mesh was placed above and in parallel to the metal plate at interval of 3mm. This photoconductive mesh sieve was made of fine brass wires coated with a zinc oxide series photoconductive material. The resolution test chart published by the Electrophotographic Society was put on the aforesaid mesh sieve, and then the surface of this resolution test chart was exposed to a light source of 800 Lux sec. Thus, the photoconductive mesh sieve was imparted with conductivity having an imagewise distribution. Then, the sample was developed in the same manner as in Example 1. Consequently, in case of $d/\epsilon_s<1.5$ an image having a resolution of 5 lines/mm was obtained, and in case of $d/\epsilon_s < 1.3$ a clear image having a resolution of 5 lines/mm was obtained.

EXAMPLE 4

Images were produced in the same manner as in Example 3 using samples prepared in Example 2 under the same conditions as in Example 2. Consequently, an image having a resolution of 5 lines/mm was obtained in case of $d/\epsilon_s < 1.65$, and further a clear image having a resolution of 5 lines/mm was obtained in case of $d/\epsilon_s < 1.5$.

EXAMPLE 5

Electrostatic latent images were produced on the respective recording material samples prepared in Example 1 using the equipment shown in FIG. 7. Briefly described the equipment used was: a 2mm thick aluminium plate was used as the anode, and as a photoelectron-emitting surface of a cathode a 1mm thick lead plate attached to an aluminium plate. The recording layer and the cathode were placed with a spacing of 1mm therebetween, and the space therebetween was filled with a mixed gas containing argon and isobutane at a volume ratio of 9:1, and the gas was kept at the pressure of 720 Torr. A potential of 2300V was applied between the anode and the cathode. Under these circumstances, a subject comprising a lead plate of 3mm thick having an aperture of 2cm × 2cm size was separately exposed to X-rays of two dosages, 2 miliroentgen and 4 miliroentgen, radiated under a tube voltage of 75KV. Other conditions were the same as in Example 1. Consequently, similar results to those obtained in Example 1 and Example 2 were obtained.

EXAMPLE 6

A recording layer was produced by applying a resinous solution prepared in Example 1 to a conductive layer provided beforehand on art paper of a thickness of 100μ by applying colloidal alumina to the surface of the art paper. Thus, recording material for obtaining a reflection type image was prepared. A number of samples having the recording layer in various dry thicknesses within the range of 0.09 to 90μ were prepared in the same manner as in Example 1. Images were prepared on the respective recording material samples in the same manner as in Examples 5 except that the X-ray dosage was 1 miliroentgen. Consequently, the results shown by curve 33 in FIG. 5 were obtained. The transmission density was approximately 1.5 in case of $d/\epsilon_s < 0.5$, more than 1.4 in case of $0.5 < d/\epsilon_s < 1.2$. In case of $d/\epsilon_s < 1.2$, the image density further decreased with the increase of the value of $d/\epsilon_s$.

Streaking of the images produced in the above-described procedures was examined in the same manner as in Example 1. Thus, the results shown by the curve 35 and the curve 35' in FIGS. 6A and 6B were obtained. No streak occurred in the range of $d/\epsilon_s < 0.75$, the length of each streak was less than 0.05mm or so in the range of $0.75 < d/\epsilon_s < 1.2$, less than about 0.1mm in the range of $1.2 < d/\epsilon_s < 1.5$, and less than about 0.2mm in the range of $1.5 < d/\epsilon_s < 1.65$. On the other hand, in the range of $d/\epsilon_s < 1.65$, the streak magnitude was found to increase markedly with the increase of the value of $d/\epsilon_s$.

EXAMPLE 7

As recording materials and the equipment for producing electrostatic latent images thereon, those which were described in Example 5 were employed except for the subject. The subject used herein was composed of a lead plate of a thickness of 3mm and having an aperture 30mm long in X-direction and 2mm long in Y-direction. The recording materials were developed with a commercially available developer for electron recopying (manufactured by Ricoh Company Ltd.) using a developing electrode for one minute, and then rinsed gently with kerosene. The image density of the image thus obtained was measured in the Y-direction using a microdensitometer. The length of the streak was again determined on the basis of the value corresponding to the density of base density + 0.2. Results similar to those of Example 2 were obtained.

EXAMPLE 8

A resinous solution was prepared by diluting a styrenated alkyd resin containing varnish as a non-volatile component in the concentration of 50 wt % (Styrezole 4250 R) with toluene. A recording layer was produced by applying this solution to a transparent conductive layer prepared beforehand by depositing a thin palladium film onto the surface of a polyethylene terephthalate film of a thickness of 100μ (Toray High Beam T-Type 100L-TL02).

Then, these recording materials were tested in the same manner as in Examples 1, 2 and 5. It was confirmed that results similar to those of the above-described examples could be obtained.

EXAMPLE 9

Charges were uniformly collected on the recording layer over a definite 5cm × 5cm area. The charges were generated by X-rays emitted from an X-ray tube under an applied voltage of 100KV with a dosage of 8mR radiated through a lead plate of a thickness of 5mm and having a 5cm × 5cm aperture. The recording material and the equipment employed in Example 5 were used under the same conditions as in Example 5. The charge amount per unit area collected on each of several of the aforesaid recording layers was determined by measuring the value of current which flowed during one second in the earthed circuit connecting with the recording material.

The results obtained were as illustrated below:

| Charge Amount | The $d/\epsilon_s$ Value |
|---|---|
| $2 \times 10^{-7}$ coulomb/cm$^2$ | 0.5 |
| $1.9 \times 10^{-7}$ coulomb/cm$^2$ | 1.0 |
| $0.9 \times 10^{-7}$ coulomb/cm$^2$ | 3 |
| $0.5 \times 10^{-7}$ coulomb/cm$^2$ | 10 |

It was found that the amount of charge collection in case of $d/\epsilon_s = 10$ was equal to a quarter of the amount of charge collection in case of $d/\epsilon_s = 1$, and the efficiency of charge collection was excellent in case of $d/\epsilon_s < 1$.

EXAMPLE 10

An electrostatic latent image was produced by a resolution test chart made of stainless steel of a thickness 0.2mm exposed to ionizing radiation using the same recording material and equipment as in Example 5. Then, the recording layer was developed in the same manner as in Example 1. The contrast of image under the condition of a resolution of 4 lines/mm was measured by a microdensitometer. Thus, the results shown in FIG. 8 were obtained. An image of high MTF was obtained when the $d/\epsilon_s$ value was within the range of not larger than 1.5 with respect to reflection type images, and not larger than 1.0 with respect to transmission type images. In xeroradiography wherein charges were subjected to multiplication by dissociation, the contrast attained in the case of $d/\epsilon_s<1.0$ was higher than the contrast attained in the case of $d/\epsilon_s=2.0$ by a factor of 7–8, as shown by the curve 53. While, when charges were subjected to multiplication by dissociation, the contrast attained in the case of $d/\epsilon_s<1.0$ was higher than that in the case of $d/\epsilon_s=2.0$ by a factor of more than 2.

We claim:

1. An electrostatic recording method comprising the steps of forming an electrostatic latent image on the surface of a dielectric electrostatic recording layer provided on a support at least the surface of which is conductive, the ratio of the thickness of said electrostatic recording layer $d$[μm] to the specific dielectric constant thereof $\epsilon_s$ being not larger than 1.65[μm] when a reflection type image is formed on said layer, and being not larger than 1.5[μm] when a transmission type image is formed thereon, and developing said electrostatic latent image by use of an electrophotographic liquid developer.

2. An ionizing radiation image recording method comprising the steps of directing a radiation which carries image information onto a material which generates photoelectrons or a gas capable of being dissociated to proportion to the intensity of the radiation to cause the material or gas to generate charged particles, and accumulating the charged particles on the surface of an electrostatic recording material by use of an external electric field to form thereon an electrostatic latent image corresponding to said image information, and developing the electrostatic latent image by use of an electrophotographic liquid developer, wherein the improvement comprising said electrostatic recording material having a dielectric recording layer on a support at least the surface of which is conductive, the ratio of the thickness of the recording layer $d$[μm to the specific dielectric constant thereof $\epsilon_s$ being not larger than 1.5[μm] when the image recorded on said layer is of reflection type, and not larger than 1.0[μm when the image recorded thereon is of transmission type.

* * * * *